US008453742B2

(12) United States Patent
Noui-Mehidi

(10) Patent No.: US 8,453,742 B2
(45) Date of Patent: Jun. 4, 2013

(54) METHOD AND APPARATUS FOR SELECTIVE ACID DIVERSION IN MATRIX ACIDIZING OPERATIONS

(75) Inventor: Mohamed Nabil Noui-Mehidi, Dhahran (SA)

(73) Assignee: Saudi Arabian Oil Company (SA)

( * ) Notice: Subject to any disclaimer, the term of this patent is extended or adjusted under 35 U.S.C. 154(b) by 339 days.

(21) Appl. No.: 12/876,542

(22) Filed: Sep. 7, 2010

(65) Prior Publication Data

US 2012/0055675 A1 Mar. 8, 2012

(51) Int. Cl.
*E21B 43/16* (2006.01)

(52) U.S. Cl.
CPC ..... *E21B 43/162* (2013.01)
USPC ..... 166/307; 166/90.1

(58) Field of Classification Search
USPC ..... 166/307, 90.1, 177.7
See application file for complete search history.

(56) References Cited

U.S. PATENT DOCUMENTS

| | | | | |
|---|---|---|---|---|
| 2,631,673 | A * | 3/1953 | Halderson et al. | 166/307 |
| 4,354,552 | A * | 10/1982 | Zingg | 166/90.1 |
| 4,436,166 | A | 3/1984 | Hayatdavoudi et al. | |
| 4,991,314 | A | 2/1991 | Allen | |
| 6,029,746 | A | 2/2000 | Dodd | |
| 6,382,321 | B1 | 5/2002 | Bates et al. | |
| 6,575,247 | B2 | 6/2003 | Tolman et al. | |
| 6,832,655 | B2 | 12/2004 | Ravensbergen et al. | |
| 2003/0146154 | A1 | 8/2003 | Moriarty et al. | |
| 2005/0263284 | A1 | 12/2005 | Justus | |
| 2010/0084134 | A1 * | 4/2010 | Tulissi et al. | 166/281 |
| 2010/0186959 | A1 * | 7/2010 | Stegemoeller et al. | 166/305.1 |

FOREIGN PATENT DOCUMENTS

GB 2225340 A 5/1990

OTHER PUBLICATIONS

Campbell, A. and Brunskill, D., Advances in Coiled Tubing Jetting Technology, SPE 60721, 2000 SPE/ICoTA Coiled Tubing Roundtable held in Houston, TX, Apr. 5-6, 2000, Society of Petroleum Engineers, Inc. (2000).

Uchendu, C.V., Awoleke, O.O., Rowland, S.P. and Ndinemenu, F.O., CT-Deployed Multipurpose Nozzle for Effective Sand-Cleanout and Acidizing Operations in a Single Trip: Injector Wells Case Histories, SPE 100163, 2006 SPE/ICoTA Coiled Tubing and Well Intervention Conference and Exhibition held in the Woodlands, TX, Apr. 5-6, 2006, Society of Petroleum Engineers, Inc. (2006).

BJ Services, Inc., Advances in Coiled Tubing Technology, www.eandpnet.com, Nov. 2006, Hart Publications, Houston, Texas.

Campbell, A. and Brunskill, D., Advanced in Coiled Tubing Jetting Technology, SPE 60721, 2000 SPE/ICoTA Coiled Tubing Roundtable held in Houston, TX, Apr. 5-6, 2000, Society of Petroleum Engineers, Inc. (2000).

PCT International Search Report dated Apr. 25, 2012; International Application No. PCT/US2011/048191; International Filing Date: Aug. 18, 2011.

(Continued)

*Primary Examiner* — William P Neuder
(74) *Attorney, Agent, or Firm* — Bracewell & Giuliani LLP

(57) ABSTRACT

An apparatus and method for selectively delivering a fluid to a targeted area through the use of vortices that are experiencing Taylor-Couette flow. Rotation of the outer surface of a body of the apparatus causes fluid within the annular area between a wellbore and the outer surface to form opposing vortices, which can then be used to selectively deliver the fluid to the targeted area, such as areas of low permeability of a reservoir, in order to improve flow characteristics of a producing area.

20 Claims, 2 Drawing Sheets

OTHER PUBLICATIONS

Philip, Z., Sharma, M,M., Chenevert, M.E. and Tthe University of Texas at Austin; The Role of Taylor Vortices in the Transport of Drill Cuttings; SPE 39504; Presented at the 1998 SPE India Oil and Gas Conference and Exhibition held in New Delhi, India, Apr. 7-9, 1998; pp. 1-7; Society of Petroleum Engineers, Inc. 1998.

Noui-Mehidi, M.N., and Amanullah, M.; Effect of Borehole Inclination, Annular Clearance, on the Hole Cleaning Efficiency for Water Based Drilling Muds; SPE 136937; Presented at the 2010 SPE/DGS Annual Technical Symposium and Exhibition held in Al-Khobar, Saudi Arabia, Apr. 4-7, 2010; pp. 1-6; Society of Petroleum Engineers, Inc. 1998.

* cited by examiner

METHOD AND APPARATUS FOR SELECTIVE ACID DIVERSION IN MATRIX ACIDIZING OPERATIONS

TECHNICAL FIELD OF THE INVENTION

The present invention relates to an apparatus and method for delivering a fluid to a targeted area through the use of vortical flow. In particular, the present invention can be used for acid diversion in matrix acidizing operations.

BACKGROUND OF THE INVENTION

It is a common practice to acidize subterranean formations in order to increase the permeability thereof. For example, in the petroleum industry, it is conventional to inject an acidizing fluid into a well in order to increase the permeability of a surrounding hydrocarbon-bearing formation and thus facilitate the flow of hydrocarbons into the well from the formation. Such acidizing techniques are generally referred to as "matrix acidizing" procedures.

In matrix acidizing, the acidizing fluid is passed into the formation from the well at a pressure below the breakdown pressure of the formation. In this case, increase in permeability is effected primarily by the chemical reaction of the acid within the formation with little or no permeability increase being due to mechanical disruptions within the formation as in fracturing.

However, one critical factor to the success of a matrix acidizing treatment is the adequate placement of the acid so that all productive regions are contacted by the acid. Since there is significant difference in reservoir permeability, the acid trends to flow primarily in the zone of high permeability leaving low permeability zones untreated. Thus the techniques of acid placement during matrix acidizing are very important. The more the common techniques for acid diversion include: mechanical zone isolation, ball sealers, particulate diverging agents, viscosified acids and foams. However, each of these techniques has advantages and limitations.

For example, the ball sealers method is a popular diversion method whereby ball sealers are added to the treatment fluids, allowing the ball sealers to fill perforations or regions of high permeability. The ball sealers are usually recovered once the injection is terminated and the wellbore pressure drops. Ball sealers are mostly effective in newer wells with limited number of perforations. However, in older wells with damaged perforations or with large perforation density, the effectiveness of ball sealers is dramatically reduced. Ball sealers also require smooth and symmetrical perforations or homogeneous formations for the ball to seat well and divert the fluid to other zones. Additionally, in instances where the perforations or the formation is irregular or non-homogenous, the balls have a lower probability of sealing properly. Most importantly, the success in ball sealers diversion depends strongly on the injection rate for the balls to seal the "high space regions," as well as the settling velocity of the ball in the carrying fluid, and thus the operation requires an excess of ball sealers to be pumped with the fluid to overcome these limitations.

For particulate diverging agents, a relatively low-permeability filter cake is formed on the formation face to achieve diversion. The pressure drop through this filter cake increases the flow resistance and thus diverts the acid to the other parts of the formation. In order for this operation to succeed, the particulate diverging agents must form a low-permeability filter cake and must be easily removed after treatment. For permeabilities above a certain value, the divergent agents do not have a good performance because they cause a great invaded region, especially in regions of the reservoir where different permeabilities exist, which complicates both the diverting process and the clean-up once the operation is finished.

Acids viscosification is accomplished by adding polymers and optional cross-linking agents. The mechanism of diversion is viscous diversion, by which the increase in flow resistance in higher-permeability regions occurs due to the presence of a bank of viscous fluid. However, the radius of the penetration of the viscosified acid is limited by the injected volume.

Foamed acids can act as diverting agents due to the reduced mobility in the rock resulting from the presence of the liquid film that separates the bubbles from the carrying liquid. This gives the foam an overall lower mobility in rocks. However, the efficiency of foamed acids is lower in damaged rock zones as compared to lower-permeability zones due to the foam effective viscosity, i.e. mobility differs between layers as well as the propagation rate. Foam, like acids, also increases the resistance to flow into a given interval by reducing liquid mobility.

As such, foamed acids, acid viscosification, and diverging agents all require the introduction of additional substances into the borehole, which further increases costs and complexity.

SUMMARY OF THE INVENTION

The present invention is directed to a method that satisfies at least one of these needs. For example, an embodiment of the present invention can simplify mechanical techniques for matrix acidizing and can enhance zonal treatment in the formation by targeting low permeability zones as well as high permeability zones simultaneously. An embodiment of the present invention can also permit dispersion of acid to specifically designated zones with excellent delivery control.

The present invention includes a standing vortex apparatus for selective fluid diversion in operations in a wellbore having a wellbore inner diameter. In one embodiment, the standing vortex apparatus includes a body that is operable to be disposed within the wellbore, a fluid delivery injection system, and a means for rotating. The body has an outer surface that is capable of rotation about a longitudinal axis of the body. The body has an outer diameter that is less than the wellbore inner diameter, such that when the body is disposed within the wellbore, an annular area is created between the outer surface of the body and the wellbore inner diameter. The fluid delivery injection system is in fluid communication with the body, and the fluid delivery injection system is operable to deliver a fluid to the annular area. The means for rotating is operable to rotate the outer surface about longitudinal axis of the body at a predetermined speed, such that circulation of the fluid in the annular area is controlled.

In another embodiment, the apparatus can further include a primary end plate and a secondary end plate. The primary end plate being disposed at a first boundary of the body substantially perpendicular to the longitudinal axis of the body and the secondary end plate disposed at a second boundary of the body substantially perpendicular to the longitudinal axis of the body, such that the end plates are operable to define a plurality of recirculation zones within which the fluid in the annular area is controlled.

In another embodiment, the fluid can include an erosive fluid. In one embodiment, the fluid can include an acid. In yet another embodiment, the fluid can include an acid that is selected from the group consisting of acid formulations for carbonate formations, acid formulations for sandstone formations, and combinations thereof. The acid can be any acid known in the art useful for acidizing the formation under the given physical conditions. A particularly preferred acid includes hydrochloric acid (HCl). This acid is can be used alone, or can be used in combination with other acids or as blends, for example acetic acid, formic acid, organic acids, hydrofluoric acid (HF), fluoroboric acid, ethylenediaminetetracetic acid (EDTA). Preferred acid types include demulsified acid, aqueous acid solutions, acid-like fluids and combinations thereof. In a preferred embodiment, the acid can be washed out of the hydrocarbon-producing well after acidization.

In one embodiment, sandstone formations can be treated with a mixture of HF and HCL acids at very low injections rates to avoid fracturing the formation. This acid mixture is preferable because it will dissolve clays found in drilling mud as well as the primary constituents of naturally occurring sandstones (e.g., silica, feldspar, and calcareous material). The dissolution is often so rapid that the injected acid is essentially spent by the time it reaches a few inches beyond the wellbore. In one embodiment, the HF and HCl acids are mixed in concentrations of 12% HCl and 3% HF. In another embodiment, such as for use in a carbonate formation, the acid may be a weak acid or a dilute strong acid, because of the chelating effect calcium has on fluorine. Exemplary acids for carbonate formations include HCL mixed at concentrations up to 28%. Acceptable blends include organic acids such as acetic and/or formic acid. EDTA and associated chelating agents may also be used with carbonate reservoirs.

In another embodiment, the fluid delivery injection system comprises a plurality of injection points disposed on the outer surface of the body. In another embodiment, the injection points can be angled substantially perpendicular to the outer surface of the body. In such an embodiment, fluid exiting from the injection point(s) would be introduced into the annular area at a substantially perpendicular angle to the outer surface of the body, and preferably, not at a high velocity. In another embodiment, the injection points can be spaced about along the length of the outer surface.

In another embodiment, the apparatus can further include a fluid source disposed above ground, and a hollow shaft in fluid connection with the fluid source and the body, such that the hollow shaft is operable to introduce fluid to the body from the fluid source. In one embodiment, the hollow shaft can have coiled tubing. In one embodiment, the apparatus is operable to create recirculation zones upon injection of fluid through the fluid delivery injection points and rotation of the outer surface at a sufficient angular velocity such that the recirculation zones exhibit Taylor-Couette flow.

In embodiments of the present invention, the outer surface can be shaped in many ways. For example, the outer surface can have a cylindrical shape, a conical shape, a spherical shape, a wavy wall shape, or some other design one of ordinary skill in the art could devise.

In another embodiment, the invention includes a method for selectively delivering a fluid to a targeted area. The method can include the steps of creating counter-rotating pairs of Taylor vortices within the fluid, and delivering the fluid to the targeted area through the Taylor vortices. In one embodiment, the targeted area is an area of low permeability within the underground formation. In another embodiment, the fluid comprises acid. In another embodiment, the acid can be selected from the group consisting of acid formulations for carbonate formations, acid formulations for sandstone formations, and combinations thereof.

In another embodiment, the step of creating counter-rotating pairs of Taylor vortices further includes the steps of lowering an apparatus that is in accordance with an embodiment of the present invention into the wellbore, injecting the fluid through the fluid delivery injection system, and rotating the outer surface of the body at a sufficient angular velocity to induce the formation of the Taylor vortices. In another embodiment, the delivery injection points are angled such that they inject the fluid substantially perpendicular about the outer surface of the body.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Figure 1:
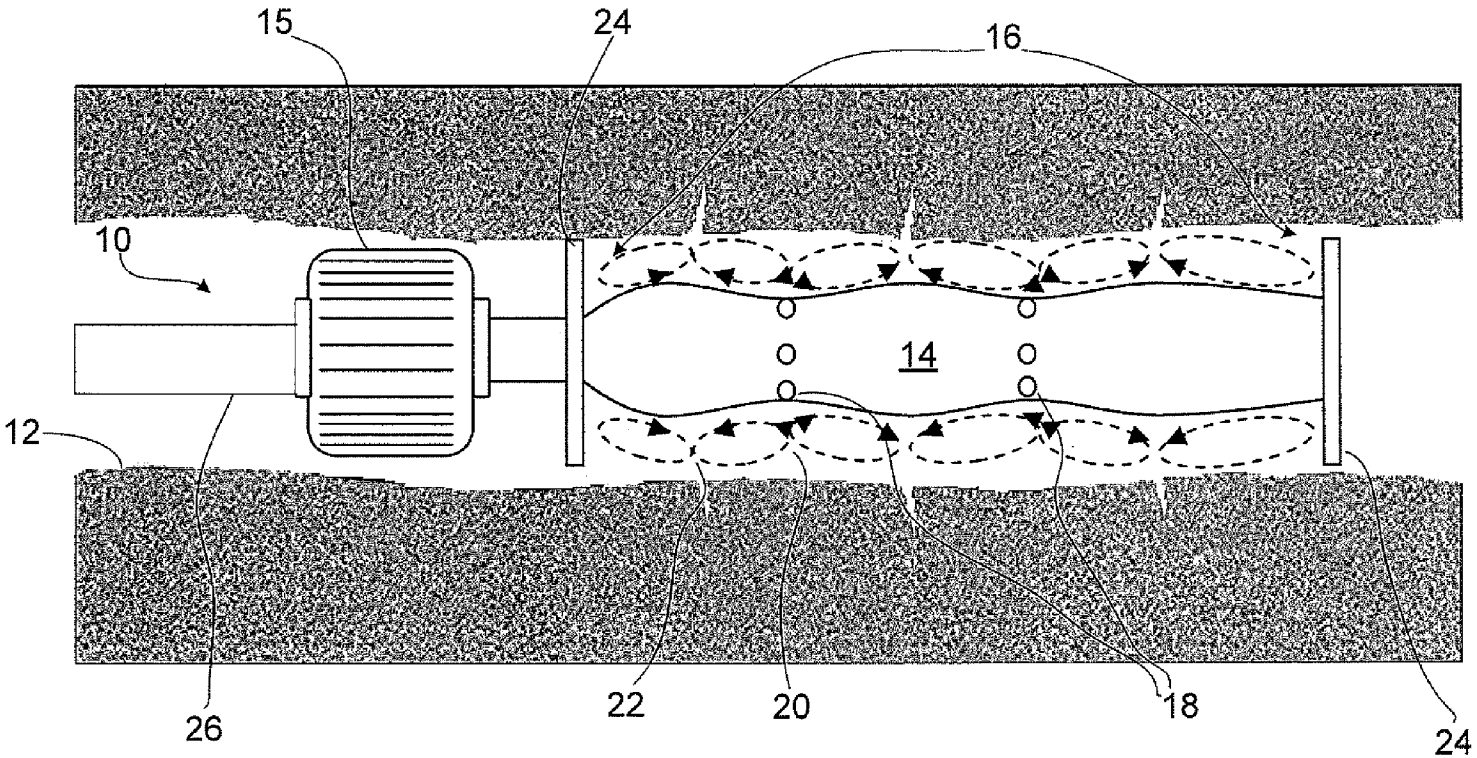
FIG. 1 is an embodiment of the present invention.

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

Generally, embodiments of the invention include the use of engineered recirculation flows (Taylor vortices) to deliver fluid to the targeted area. One embodiment employs these recirculation flows of acid during matrix acidizing operations. The apparatus can have a rotating outer surface that can have several shapes to generate the desired size and shape of the recirculation zones. The apparatus can also have injection points that are positioned on the outer surface of the body, which allow the fluid to be introduced into the annular area.

The outer surface of the body can be rotated by means of an electric motor. At certain speeds, the rotation of the outer surface of the body can create the plurality of recirculation zones called Taylor vortices. These vortices are counter-rotating two by two and create inner boundary (sink) and outer boundary (jet) flow regions in a periodic fashion. These vortices will organize the dispersion of the acid in the designated column in such way that an outer flow boundary region acts like a jet at a specific axial location at which the acid penetration is desired. The shape of the outer surface of the body defines, along with the annular space, the typical length occupied by two adjacent vortices called wavelength. The wavelength defines the interval between two desired zones for acidizing. Different optimized outer surface shapes can be used to address different formation types. As such, embodiments of the present invention used for acid delivery advantageously allow for the ability to selectively divert the acid with higher efficiency than conventional methods and to enhance acid contact resulting in better acid placement and reduction in costs.

In fluid dynamics, the Taylor-Couette flow consists of a viscous fluid confined in the gap between an inner rotating member and an exterior member. For low angular velocities, measured by the Reynolds number Re, the flow is steady and purely azimuthal. This basic state is known as circular Couette flow. When the angular velocity of the inner rotating member is increased above a certain threshold, Couette flow becomes unstable and a secondary steady state characterized by axisymmetric toroidal vortices, known as Taylor vortex flow, emerges.

The flow between two concentric cylinders known in the literature as Taylor-Couette presents an ideal mechanical control tool due to the presence of the so-called Taylor vortices, which counter-rotate two-by-two to form a pair of vortices having a wavelength. The perfect alignment of these vortices provides a constant geometrical wavelength, which has alternating jet regions and sink regions due to the counter-rotation of a pair of vortices.

In one embodiment, the wellbore can be regarded as the external member in a Taylor-Couette apparatus. The fluid can be delivered to the annular area thru the injection points, which in one embodiment can be located on the outer surface of the body. In one embodiment, the body can be hollow, which allows for the fluid to flow within the body, out the injection points, and into the annular area. In one embodiment, coiled tubing may be used to deliver the fluid down the wellbore and into the body.

Several studies in the literature have shown that hybrid gap geometries such as cones, spheres, wavy walls, also result in Taylor vortices with elongated shapes that have different axial wavelength. A specific designed shape of the inner rotating body associated with a specific rotation can result in a specific wavelength (vortices pair length) with periodically arranged jet zones, which will send the acid into the formation and a sink zone which collect the surrounding acid and send back to the jet zone.

Embodiments of the present invention encompass both vertical and horizontal matrix operations since Taylor vortices can be present in both vertical and horizontal alignments. The effective mechanical control of the size and disposition of the vortices will depend on the shape of the outer surface of the body, the delivery points, the type of fluid and its physical properties, and the rotational speed of the outer surface of the body.

Because the apparatus and method of the present invention direct fluid flow through the formation of vortices, embodiments of the present invention do not require the use of high pressure jets. Additionally, embodiments of the present invention can successfully direct fluid to the target area without simultaneous injection of the fluid. In one embodiment, circulation of application of the fluid to the target area is accomplished by the rotation of the outer surface of the apparatus, and not due to the rotation of fluid coming out of the injection points.

Now turning to FIG. 1, standing vortex apparatus 10 is disposed within wellbore 12. While wellbore 12 is depicted in a horizontal fashion, standing vortex apparatus 10 can also be effective for wellbore 12 that are vertical. Standing vortex apparatus 10 has outer surface 14 that is operable to spin about the longitudinal axis of standing vortex apparatus 10 using motor 15. Fluid enters annular area 16 via injection points 18. When fluid has filled annular area 16, outer surface 14 is spun at a predetermined rate such that sink flow region 20 and jet flow region 22 form (collectively a recirculation zone). Jet flow region 22 advantageously provides fluid to the targeted area, while sink flow region 20 provides for fluid return. In an optional embodiment, standing vortex apparatus 10 can include end plates 24, which can assist with keeping the fluid within annular area 16. Coiled tubing 26 can be used to transport the fluid from the surface to standing vortex apparatus 10.

Figure 2:
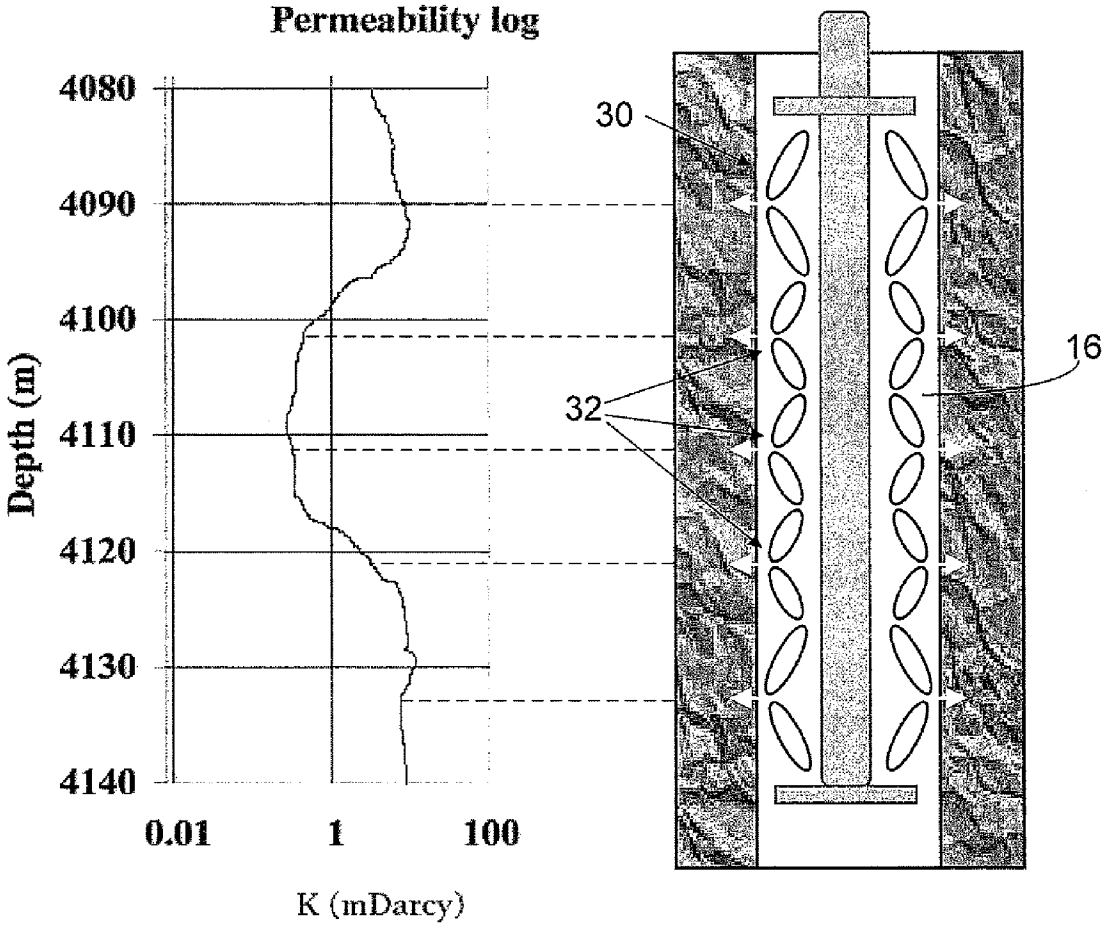
FIG. 2 is an embodiment of the present invention.

FIG. 2 displays how a recirculation zone can be disposed in annular area 16 so as to match up with the permeability characteristics of a formation. The permeability log on the left side of FIG. 2 shows varying degrees of permeability within the formation. In the embodiment shown in FIG. 2, areas of high permeability would preferably have a larger recirculation zone 30, while areas of low permeability would preferably have several smaller recirculation zones 32 (as illustrated by the relative sizes of circles). In an embodiment of the present invention, circulation of the fluid within the recirculation zones is due to vortices formed as a result of spinning outer surface 14 of standing vortex apparatus 10, and not because of circulation imparted by the injection of the fluid from injection points 18.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed.

I claim:

1. A standing vortex apparatus for selective fluid diversion in operations in a wellbore having a wellbore inner diameter, the wellbore being disposed in a hydrocarbon producing strata, the standing vortex apparatus comprising:

a body operable to be disposed within the wellbore, the body having an outer surface, the outer surface capable of rotation about a longitudinal axis of the body, the body having an outer diameter that is less than the wellbore inner diameter, such that when the body is disposed within the wellbore, an annular area is created between the outer surface of the body and the wellbore inner diameter;

a fluid delivery injection system in fluid communication with the body, the fluid delivery injection system operable to deliver an erosive fluid to the annular area; and a means for rotating the outer surface about its longitudinal axis at a predetermined speed, such that circulation of the fluid in the annular area is controlled.

2. The apparatus of claim 1, wherein the apparatus further comprises a primary end plate and a secondary end plate, the primary end plate disposed at a first boundary of the body substantially perpendicular to the longitudinal axis of the body and the secondary end plate disposed at a second boundary of the body substantially perpendicular to the longitudinal axis of the body, such that the end plates are operable to define a plurality of recirculation zones within which the fluid in the annular area is controlled.

3. The apparatus of claim 1, wherein the fluid comprises an acid.

4. The apparatus of claim 1, wherein the fluid comprises an acid, wherein the acid is selected from the group consisting of acid formulations for carbonate formations, acid formulations for sandstone formations, and combinations thereof.

5. The apparatus of claim 1, wherein the fluid delivery injection system comprises a plurality of injection points disposed on the outer surface of the body.

6. The apparatus of claim 5, wherein the injection points are angled substantially perpendicular to the outer surface of the body.

7. The apparatus of claim 5, wherein the injection points are spaced about along a length of the outer surface.

8. The apparatus of claim 1, further comprising a fluid source disposed above ground; and a hollow shaft in fluid connection with the fluid source and the body, such that the hollow shaft is operable to introduce fluid to the body from the fluid source.

9. The apparatus of claim 8, wherein the hollow shaft comprises coiled tubing.

10. The apparatus of claim 1, wherein the apparatus is operable to create recirculation zones upon injection of fluid from the fluid delivery injection system and rotation of the outer surface at a sufficient angular velocity such that the recirculation zones exhibit Taylor-Couette flow.

11. The apparatus of claim 1, wherein the outer surface comprises a cylindrical shape.

12. The apparatus of claim 1, wherein the outer surface comprises a conical shape.

13. The apparatus of claim 1, wherein the outer surface comprises a spherical shape.

14. The apparatus of claim 1, wherein the outer surface comprises a wavy wall shape.

15. A method for treating a targeted area in a wellbore comprising:

providing an erosive fluid in the wellbore;

creating counter-rotating pairs of Taylor vortices within the erosive fluid; and delivering the fluid to the targeted area through the Taylor vortices.

16. The method of claim 15, wherein the targeted area is an area of low permeability within an underground formation that is adjacent the wellbore.

17. The method of claim 15, wherein the fluid comprises an acid.

18. The method of claim 15, wherein the fluid is selected from the group consisting of acid formulations for carbonate formations, acid formulations for sandstone formations, and combinations thereof.

19. The method of claim 15, wherein the step of creating counter-rotating pairs of Taylor vortices further comprises the steps of:

providing an apparatus in the wellbore, where the apparatus comprises a body with an outer surface and delivery injection points on the body;

discharging the fluid from the body through the delivery injection points; and rotating the outer surface of the body at a sufficient angular velocity to induce the formation of the Taylor vortices.

20. The method of claim 19, wherein the delivery injection points are angled so that the fluid is discharged from the injection points in a direction substantially perpendicular about the outer surface of the body.

* * * * *